US007794077B2

(12) United States Patent
Falser et al.

(10) Patent No.: US 7,794,077 B2
(45) Date of Patent: Sep. 14, 2010

(54) INKJET PRINTER

(75) Inventors: Klaus Falser, Kaltern an der Weinstrasse (IT); Peter Duracher, Sillian (AT); Franz Obertegger, Brixen (IT)

(73) Assignee: Durst Phototechnik Digital Technology GmbH (AT)

( * ) Notice: Subject to any disclaimer, the term of this patent is extended or adjusted under 35 U.S.C. 154(b) by 711 days.

(21) Appl. No.: 11/056,799

(22) Filed: Feb. 11, 2005

(65) Prior Publication Data

US 2005/0200679 A1 Sep. 15, 2005

(30) Foreign Application Priority Data

Feb. 12, 2004 (AT) ..... A 227/2004
Jan. 26, 2005 (AT) ..... A 118/2005

(51) Int. Cl.
*B41J 2/01* (2006.01)

(52) U.S. Cl. ..... 347/104; 347/101; 347/102; 347/15; 347/37; 347/43; 101/183; 355/32; 400/212

(58) Field of Classification Search ..... None
See application file for complete search history.

(56) References Cited

U.S. PATENT DOCUMENTS 4,593,295 A * 6/1986 Matsufuji et al. ..... 347/41
4,630,076 A * 12/1986 Yoshimura ..... 347/43
4,812,899 A * 3/1989 Kueppers ..... 358/500
5,376,958 A * 12/1994 Richtsmeier et al. ..... 347/104
5,668,584 A * 9/1997 Broder et al. ..... 347/102
5,764,254 A 6/1998 Nicoloff, Jr. et al.
5,933,164 A * 8/1999 Sato et al. ..... 347/43
6,428,143 B2 8/2002 Irihara et al.
6,533,382 B1 * 3/2003 Tomida et al. ..... 347/15
6,585,352 B1 * 7/2003 Torgerson et al. ..... 347/40
6,637,860 B1 * 10/2003 Madeley ..... 347/42
6,655,797 B2 12/2003 Smith et al.
6,902,249 B2 * 6/2005 Suzuki et al. ..... 347/15
7,029,096 B2 * 4/2006 Weijkamp et al. ..... 347/40
2006/0158481 A1 7/2006 Spevak et al.

FOREIGN PATENT DOCUMENTS

AT 411 975 B 8/2004
JP 61-104856 A 5/1986
JP 2002-038063 2/2002

* cited by examiner

*Primary Examiner*—Matthew Luu
*Assistant Examiner*—John P Zimmermann
(74) *Attorney, Agent, or Firm*—Lerner, David, Littenberg, Krumholz & Mentlik, LLP

(57) ABSTRACT

An inkjet printer with a print head carriage is disposed above the printing bed for displacing a print head unit in a transverse feed direction, a print head unit with at least one print head being provided for every color to be printed and having at least one nozzle row oriented in the forward feed direction of the print medium. Another print head unit is provided for applying white ink, whereby the row length of the color print head unit and the row length of the other print head unit at least partially overlap with one another, and whereby of the nozzles of the nozzle row of the color print head unit, only those nozzles lying outside of the overlap region between the row length of the color print head unit and the row length of the other print head unit activated for applying white ink are activated.

7 Claims, 14 Drawing Sheets

INKJET PRINTER

CROSS REFERENCE TO RELATED APPLICATIONS

Applicant claims priority under 35 U.S.C. §119 of AUSTRIAN Patent Application No. A 227/2004 filed on 12 Feb., 2004 and of AUSTRIAN Patent Application No. A 118/2005 filed on 26 Jan. 2005.

BACKGROUND OF THE INVENTION

1. Field of the Invention

The invention relates to an inkjet printer, a method of printing images onto a print medium and a printed image, having the features specified in the introductory parts of the claims.

2. The Prior Art

Inkjet printers usually produce images using white print media and when storing digital image data, it is also standard practice to provide information about the coloured, i.e. not the white, dots only. When printing images onto print media made from a non-white material, however, this leads to a distortion of the colours in the printed image. In these situations, the colour of areas remaining free which are intended to appear white is the same colour as the print medium, whereas the colour of other image dots is altered by the colour of the print medium due to the fact that some of the incident white light passes through the corresponding ink dot whilst another part of the light is absorbed on the print medium.

SUMMARY OF THE INVENTION

Accordingly, the objective of the invention is to propose an inkjet printer by means of which it is possible to produce printed images with the correct colours whilst simultaneously ensuring a high productivity. Another objective of the invention is to propose a method of printing images in which the colours are as true as possible. Yet another objective of the invention is to propose a device and a method of printing images, by means of which visual effects of the image surface can be selectively influenced.

This objective is achieved by the invention by means of an inkjet printer incorporating the characterising features defined in the claims. The advantage of this approach is that, with an inkjet printer of this type, images can be produced from digital image data which additionally contain areas with ink dots of white or colourless ink for example, these ink dots not being contained in the original image data. This enables a base coat to be applied to the image using white ink, for example, which is applied prior to applying the actual image, or individual parts of the image or also the entire image can be selectively covered with colourless ink in order to produce gloss effects.

The advantage of the embodiments of the inkjet printer defined in the claims is that they permit a spatially compact structure of the print head units on the print head carriage, thereby keeping inaccuracies in the positioning of the nozzles of the various print heads caused by mechanical tension or heat expansion of the print head carriage or print head systems as low as possible, since these would otherwise lead to errors in the image.

The embodiment of the inkjet printer defined in the claims has an advantage in that images can also be reproduced with true colours on white print media and a uniform gloss can be created on the surface of the images.

The advantage of the way the individual print head units are positioned on the print head carriage as defined in the claims is that both the base coat of the image can be printed using white ink for example and the actual colours can be applied, one directly after the other, during a same transverse displacement.

The embodiment of the inkjet printer defined in the claims enables a base coat to be applied to the image first of all during a first transverse displacement of the print head carriage and then the coloured image dots to be applied during a second transverse displacement of the print carriage.

Also of advantage is the embodiment of the inkjet printer defined in the claims. It enables the initially applied coloured ink dots to be subsequently covered with a colourless ink, for example.

The embodiments of the inkjet printer defined in the claims have an advantage in that they have an appropriately short overlap region between the row length of the print heads and printer head unit for the additional ink dots with the row length of the colour print head system.

The advantage of the inkjet printer defined in the claims is that during a transverse displacement of the print head carriage with the print head unit for printing the additional ink dots, the number of ink dots which can be produced is the same as that produced with the colour print head system.

Also of advantage is the inkjet printer defined in the claims, since it is able to produce an appropriate multiple of the coloured dot density or density of the rows of coloured dots on the print medium as a proportion of the dot density of the nozzles of the print heads.

The objective of the invention is also independently achieved by means of the inkjet printer incorporating the characterising features defined in the claims. It advantageously enables images to be reproduced in true colours on non-white print media as well as producing different gloss effects on the surfaces of images.

The objective of the invention is also achieved by the method incorporating the characterising features defined in the claims. This method advantageously permits a variety of different print media and print media surfaces to be printed, enabling the visual effects and the colour of the print medium to be compensated in order to produce a reproduction in true colours.

The advantage of the additional characteristic of the method as defined in the claims is that if non-white print media are used, areas of the image for which no image data is available can be covered with white ink, thereby producing a more natural impression.

The advantage of the embodiment of the method defined in the claims is that mixed colours can be produced at individual image points.

Also of advantage are the embodiments of the method defined in the claims since a base coat of the image may be produced with white ink, for example, thereby enabling images to be reproduced in true colours.

The advantage of the embodiments of the method defined in the claims is that if working with transparent print media where the image is intended to be visible through the medium, an application of white ink, for example, may be applied, thereby enabling a base coat effect to be achieved.

The embodiment of the method defined in the claims is also of advantage because it enables systematic image errors, e.g. striping, to be compensated or made imperceptible.

The embodiment of the method defined in the claims offers a compact structure of the print head unit on the print head carriage, thereby keeping mechanical inaccuracies and hence resultant image errors to a minimum.

The approach defined in the claims enables the effect of colour on non-white print media to be compensated, thereby producing images in true colours.

Also of advantage is the approach defined in the claims, because it enables different visual effects to be produced on the surface of the image.

The characteristic feature of the method defined in the claims enables a uniform gloss to be achieved on the image surface across the entire area of the image.

The advantage of the characteristic features of the method defined in the claims is that graphic or text elements at appropriately selected points of the image can be visually highlighted due to the enhanced gloss of the colourless ink dots applied.

Also of advantage is the approach of the method defined in the claims, because it enables visual effects caused by irregularities in the surface of the ink dots which would impair the image quality to be compensated.

The advantage of the embodiment of the method defined in the claims is that two images can be produced which are visible in different directions or from different sides of a transparent print medium in a single print routine. Another particular advantage is the fact that image elements of the respective remote image, whereby the oppositely lying side is covered with other image elements, can be very precisely positioned. Effects such as security elements of the type printed on bank notes, such as watermarks for example, can also be very precisely but easily produced.

The objective of the invention is also independently achieved by means of an inkjet printer incorporating the characterising features of the claims.

Accordingly, the inkjet printer has a print head unit for every colour to be printed and several nozzle rows disposed parallel with the transverse feed direction of the print head unit are provided, each having at least one nozzle. In addition to these first print head units, the inkjet printer also has another print head unit and the ratio derived from the nozzle distance D of the nozzles in first said print head units and the nozzle distance d of the nozzles in the other print head unit is a rational number and is greater than 1. The advantage of this is that different printing processes can be run using this inkjet printer, whereby a base coat of white ink can be applied prior to printing the actual image by means of the appropriate coloured ink dots.

Also of advantage are the embodiments of the inkjet printer defined in the claims, because they permit a compact layout of the print heads on a print head carriage, which largely avoids impairments to the image quality caused by shifting of the position of the nozzles of different print heads due to heat expansion.

If the other print head unit is provided for applying white ink, the resultant advantage is that images can also be printed in true colours on non-white print media because the other print head unit applies a base coat over the entire image surface of the image to be produced, using white ink.

The advantage of the embodiment of the inkjet printer defined in the claims is that a base coat can be produced on the print medium in both displacement directions of the print head carriage and the coloured ink dots can be applied immediately afterwards on top of the previously created white ink dots. This means that an image can be reproduced at a correspondingly higher speed.

Other advantageous embodiments of the inkjet printer are also described in the claims.

The objective of the invention is also independently achieved by a method based on the characterising features defined in the claims. The advantage of this approach is that the colour-distorting effect of a non-white print medium or image background can be corrected.

Other advantageous embodiments of the method are also described in the claims.

The objective of the invention is also independently achieved by means of a printed image consisting of a print medium and a multi-coloured image applied to it, in the manner defined by the characterising features of the claims. The advantage of this approach is that a reproduction in true colours can be obtained if using non-white print media as a background for an image to be printed.

Other advantageous embodiments of the printed image are defined in the claims.

BRIEF DESCRIPTION OF THE DRAWINGS

The invention will be described in more detail below, with reference to examples of embodiments illustrated in the appended drawings. Of these.

DETAILED DESCRIPTION OF PREFERRED EMBODIMENTS

Figure 1:
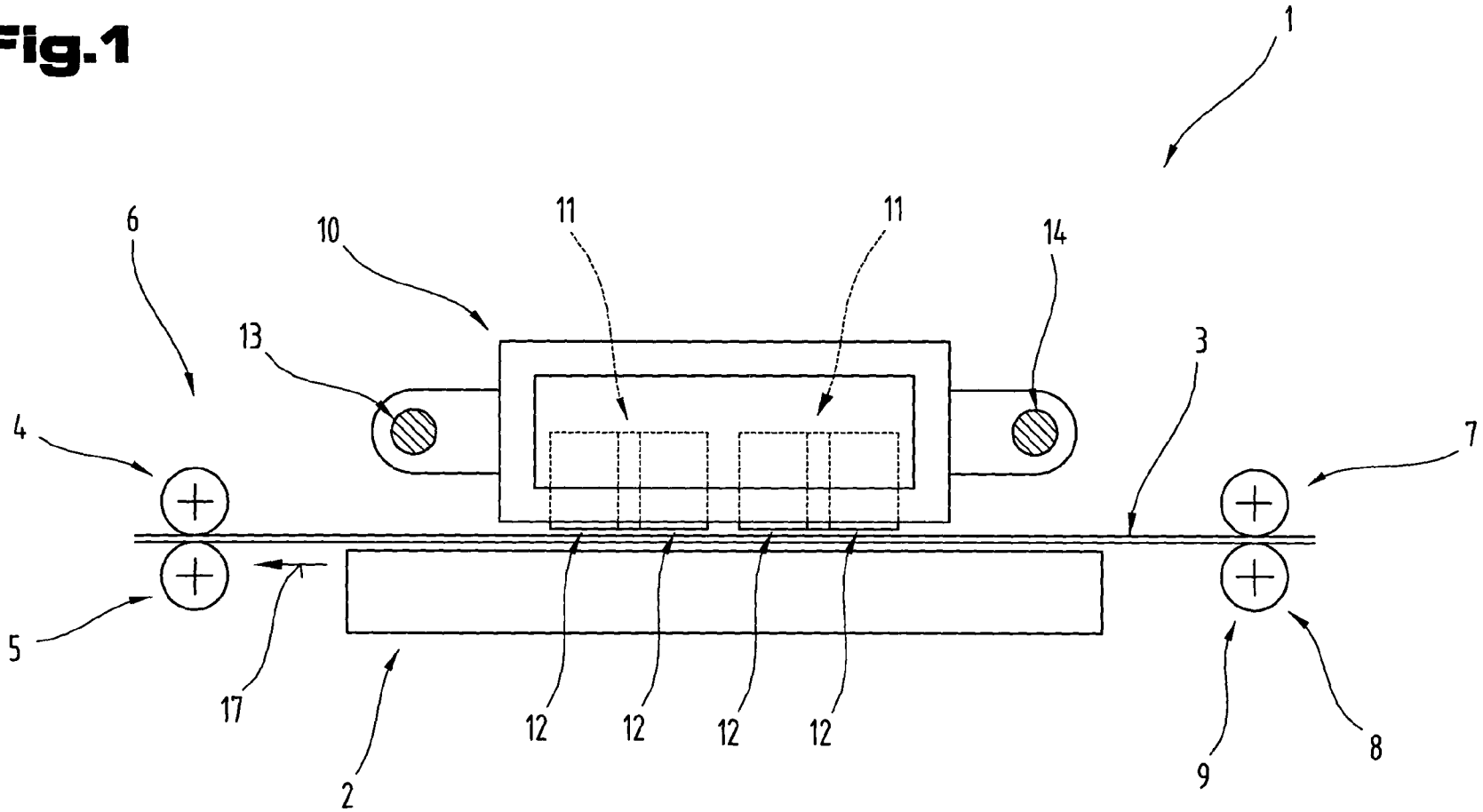
FIG. 1 is a side view of the inkjet printer.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
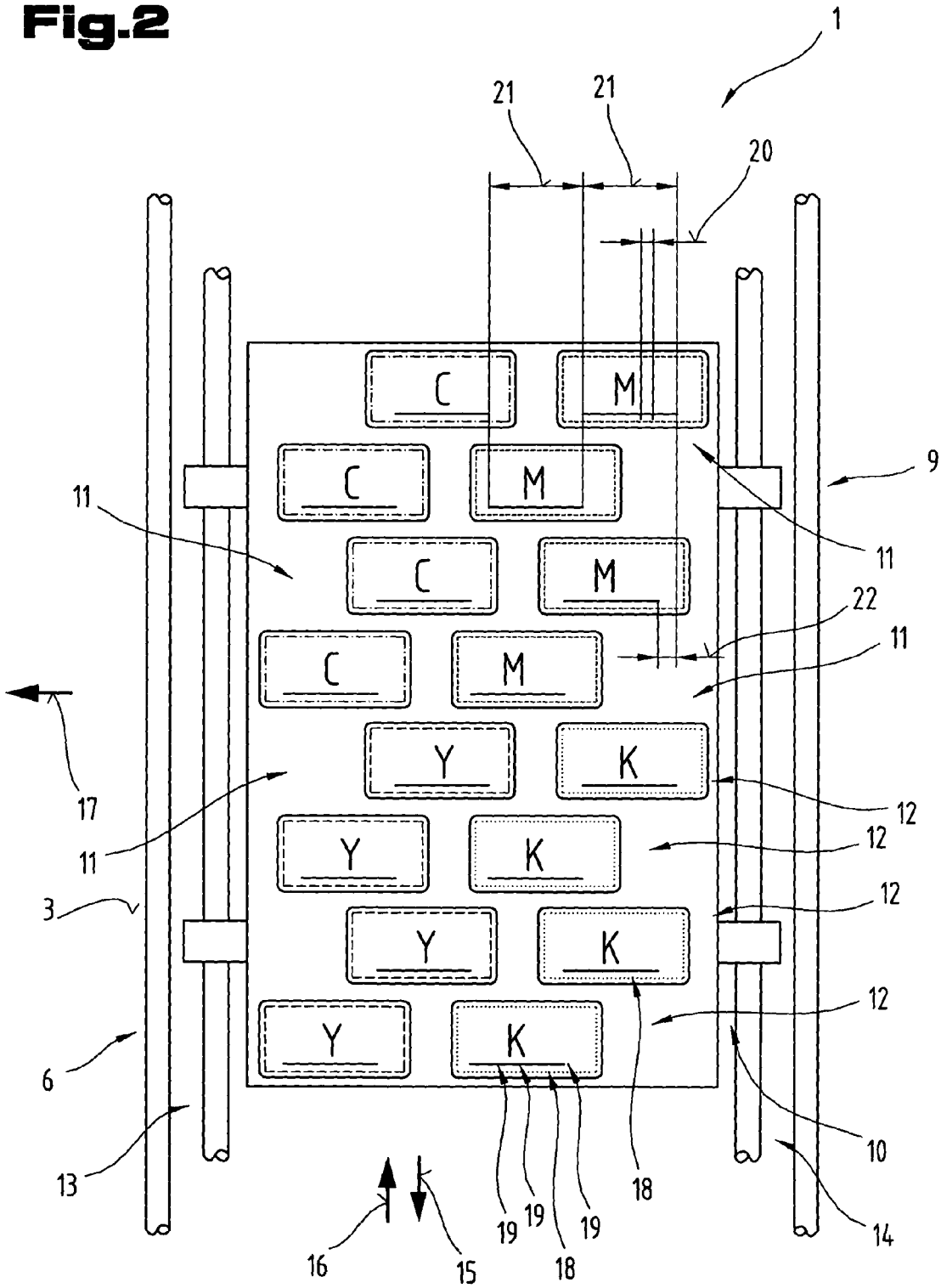
FIG. 2 is a simplified schematic diagram showing a plan view of the inkjet printer illustrated in FIG. 1.

FIGS. 1 and 2 are simplified schematic diagrams showing the central elements of an inkjet printer 1.

FIG. 1 is a side view of the inkjet printer 1. A print medium 3 waiting to be printed lies on a printing bed 2 and is firmly secured by transport rollers 4, 5 of a feed mechanism 6 and transport rollers 7 and 8 of a feed mechanism 9. Disposed above the printing bed 2 is a print head carriage 10 on top of the print medium 3 with several print head units 11 for the respective colors, the print head units 11 having several print heads 12 for each color. The print head carriage 10 can be laterally displaced in the transverse feed direction 15, 16 (see FIG. 2) above the print medium 3 on two transverse guides 13, 14. Between the transverse feed movements of the print head carriage 10, during which ink dots are applied to the print medium by means of the print heads 12, the print medium 3 is moved further in the forward feed direction 17 by means of the feed mechanisms 6 and 9.

FIG. 2 is a simplified schematic diagram showing a plan view of the inkjet printer 1. In the print head carriage 10 are four print head units 11, each comprising four print heads 12. As illustrated in FIG. 2, provision is made for applying four different colours. The individual print heads 12 each have a row of nozzles 18 oriented in the forward feed direction 17, each of which preferably has an identical number n of up to several hundred individual nozzles 19. The respective adjacent nozzles 19 of a nozzle row 18 are spaced apart from one another by a nozzle distance D 20. The print heads 12 used usually have a nozzle distance D 20 corresponding to a dot density of 90 dpi. Using a print head 12 of this type and depending on the number n of nozzles 19, it is usually possible to print a strip the width of the row length 21 with n coloured rows of dots simultaneously during a single transverse movement.

As an alternative to print heads 12 with only one nozzle row 18, however, it would also be possible to use print heads 12 with several nozzle rows 18, in which case the nozzle rows 18 would be disposed parallel with one another (as will be described below with reference to FIG. 12). This means that the print heads 12 provided will have a number n of several nozzles in each print head 12 and these nozzle rows will have at least one nozzle per nozzle row and the nozzle rows are aligned with the transverse feed direction 15 of the print head unit 11 spaced offset from one another by a nozzle distance D 20 or nozzle row distance in the feed direction 17 of the print medium 3.

In another alternative embodiment, the individual print heads 12 of a print head unit 11 are arranged in a systematic pattern in the direction of the forward feed direction 17, offset at a pitch ΔB 22. Due to an appropriate combination of pitches ΔB 22 and different displacements of the print medium 3 in the forward feed direction 17, it is simultaneously possible, firstly, to increase the density of the coloured dot rows and, secondly, to reduce image errors caused by systematic errors of the print heads 12. Since the print heads 12 are effectively disposed at a pitch ΔB 22, derived from the sum of a whole number multiple of the nozzle distance D 20 and a fraction thereof, it is possible to print coloured dot rows and coloured dot rows lying in between, thereby multiplying the density of the coloured dot rows.

As may be seen from FIG. 2, it is also possible to provide two print heads 12 so that they correspond to a print head of a double row length 21 in combination.

The image is applied to the print medium 3 by a combination of printing routines during the reciprocating motion in the transverse feed direction 15, 16 and forward feed movements of the print medium 3, by feed a length corresponding to only a fraction of the row length. The print medium 3 is therefore printed in a "line nested" arrangement whereby only every second, third, fourth line etc., of the image dots ultimately applied are printed during a transverse displacement of the print head units 11 and the lines of image dots disposed in between are not printed until another transverse displacement of the print head units 11. This printing method is also known by the name of interlacing and is described in Austrian patent application A 113/2003 filed by the same applicant. Using print heads 12 with a nozzle distance D 20, corresponding to a dot density of, for example, 90 dpi, images can therefore be printed with a resolution corresponding to a multiple, i.e. for example 180 dpi, 270 dpi, 360 dpi, etc.

Naturally, it would also be possible to provide less than four or alternatively more than four print head units 11 on the print head carriage. The four print head units 11 illustrated in FIG. 2 correspond to the colours cyan, magenta, yellow and black, used as standard in four-colour printing.

Figure 3:
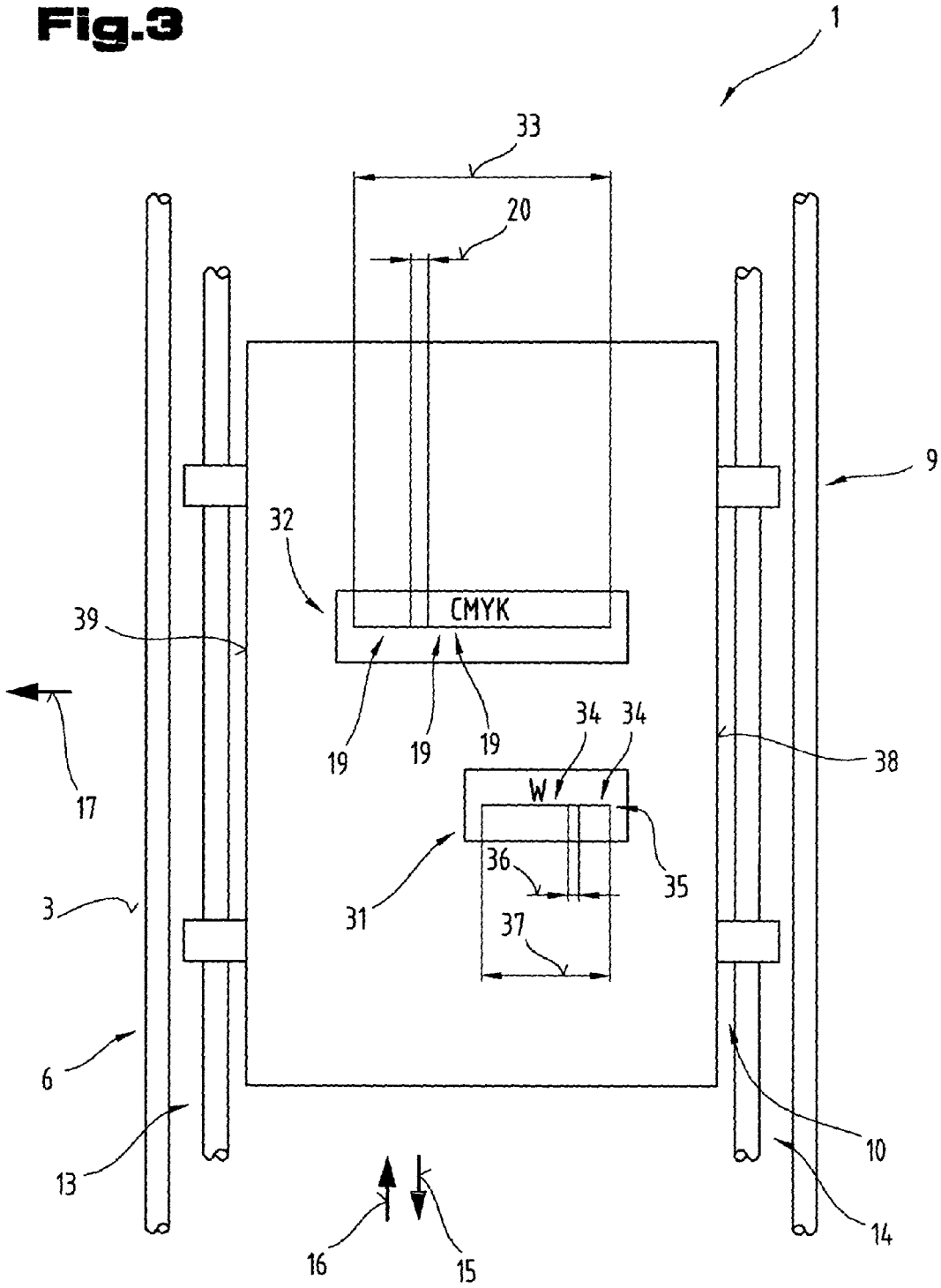
FIG. 3 shows an example of an embodiment of the inkjet printer with a print head unit for printing white ink.

FIG. 3 illustrates an example of an embodiment of the inkjet printer 1 with a print head unit 31 for printing white ink.

The print heads for printing the other colours, i.e. cyan, magenta, yellow and black, or optionally yet other colours, are symbolically indicated by a colour print head unit 32, in which the nozzles 19 are spaced apart from one another by the nozzle distance D 20 parallel with the forward feed direction 17. The colour print head unit 32 also has an effective row length 33 of nozzles 19 for each of the respective colours. The print head unit 31 for printing the white ink, on the other hand, has nozzles 34 forming a nozzle row 35. The nozzles 34 of the print head unit 31 for printing the white ink are spaced apart from one another by a nozzle distance d 36 and are distributed across a row length 37. The nozzle row 35 of the print head unit 31 for printing the white ink has a dot density of nozzle rows which is twice that of the dot density of the nozzles 19 of the colour print head unit 32, i.e. the nozzle distance d 36 is exactly half the size o the nozzle distance D 20. During a transverse displacement of the print head carriage 10, the print head unit 31 for printing the white ink is able to generate an identical number of ink lines as the colour print head unit. Depending on the ratio of nozzle distance d 36 to the nozzle distance D 20, the row length 37 of the print head unit 31 is only half the size of the row length 33 of the colour print head unit 32.

The dot density of the colour print head unit 32 might be 90 dpi, for example, and accordingly, the dot density of the print head unit 31 for printing the white ink would be 180 dpi. During a transverse displacement of the print head carriage 10, therefore, all ink lines of a strip with a width corresponding to the row length 37 are passed over by white nozzles 34. During the same transverse displacement of the print head carriage 10, however, only every second ink line of all the ink lines to be ultimately printed are passed over by the nozzles 19 of the colour print head unit 32. The forward feed length of the print mediums 3 corresponds to at least the row length 37 of the print head unit 31 and is selected so that during the next transverse displacement in the direction of the transverse feed direction 15, 16, the ink lines between those first passed over by the nozzles 19 of the colour print head unit 32 are now passed over. In specific applications used for printing onto the print medium, it may be necessary to apply white ink first to areas of the print medium where a coloured dot is to be applied by the colour print head unit 32. This will be the case, for example, if an image is to be applied to a non-white, i.e. coloured print medium 3 and it is therefore necessary to apply a base coat of white ink to the surface of the image beforehand. Another option is one where a white dot is applied first of all underneath certain coloured dots only by applying white ink with the aid of the print head unit 31, where the objective is to vary the colour intensity of the corresponding dot.

In such applications, i.e. applying a base coat for the entire image or individual colored dots of an image prior to applying the corresponding colored dots, some of the nozzles 19 of the color print head unit 32 might not be used because the white ink has to be applied first of all. This means that the only nozzles 19 of the color print head unit 32 available for applying colored dots are those which lie outside of the overlap region of the row length 37 of the print head unit 31 for applying the white ink and the row length 33 of the color print head unit 32. Consequently, since the print heads used for the print head unit 31 as a means of applying the white ink are ones whose nozzles 34 have a multiple of the dot density of the nozzles 19 of the color print head unit 32, the proportion of nozzles 19 of the color print head unit 32 that are not used during a transverse displacement of the print head carriage 10 can be reduced, which means that productivity whilst printing the print medium 3 is increased accordingly. The advantage of this is that when applying the colored dots with the color print head unit 32, the nested printing or interlacing method can continue to be used. In the embodiment described as an example here, the ratio of the row length 33 to the row length 37 or the ratio derived from the nozzle distance D 20 to the nozzle distance d 36 is selected so as to be two. Naturally, however, it would also be possible for this ratio to be greater, for example three, four, etc., in which case the productivity can be raised still further. In addition to these ratios of the nozzle distance D 20 to nozzle distance d 36 based on whole numbers, this ratio may also be selected on the basis of rational numbers. As a result, both the application of colored ink by the color print head unit 32 and the application of white ink by the print head unit 31 can still be operated on the basis of the method of printing nested ink lines or interlacing described above. On the other hand, it would also be possible to provide the color print head unit 32 with only a single print head 12 (FIG. 2), operated using the nested printing method, i.e. a pitch AB 22 of two print heads 12 will not necessarily be required in this case (FIG. 2).

If this ratio were equal to one, the situation would not be efficient because the number of reciprocating movements which the print head carriage 10 would have to make in order to produce the image on the print medium 3 would be precisely double. It would theoretically be possible to dispose the print head unit 31 for printing white ink and the colour print head unit 32 in such a way that the row length 37 and the row length 33 do not overlap. However, it is of advantage and therefore more viable if the colour print head unit 32 and the print head unit 31 for printing the white ink are disposed as compactly as possible on the print head carriage 10. In practice, this avoids any shift in the positions of the nozzles 19, 34 which might occur due to slight deformations induced by heat expansion, for example, which would impair the image quality.

Since the white ink has to be applied by the print head unit 31 first of all in order to apply a base coat for the image, it is disposed in a region of the area of the row length 33 or print head carriage 10 facing the front face 38 of the print head carriage 10. By the front face 38 is meant the face of the print head carriage 10 facing the approaching part of the print medium 3 depending on the feed direction 17 of the print medium. The coloured ink dots are then applied after the white ink dots have been applied, by the nozzles 19 facing a rear face 39 of the print head carriage 10.

In an alternative application of the inkjet printer 1, it would also be possible, using this same embodiment, during the displacement of the print head carriage 10 in the transverse feed direction 15, to also apply coloured ink dots immediately after applying the white ink, using nozzles 19 from the overlap region between row length 37 of the print head unit 31 and row length 33 of the colour print head unit 32. Although this is conditional on the white ink drying quickly enough, it also helps to increase productivity.

Figure 4:
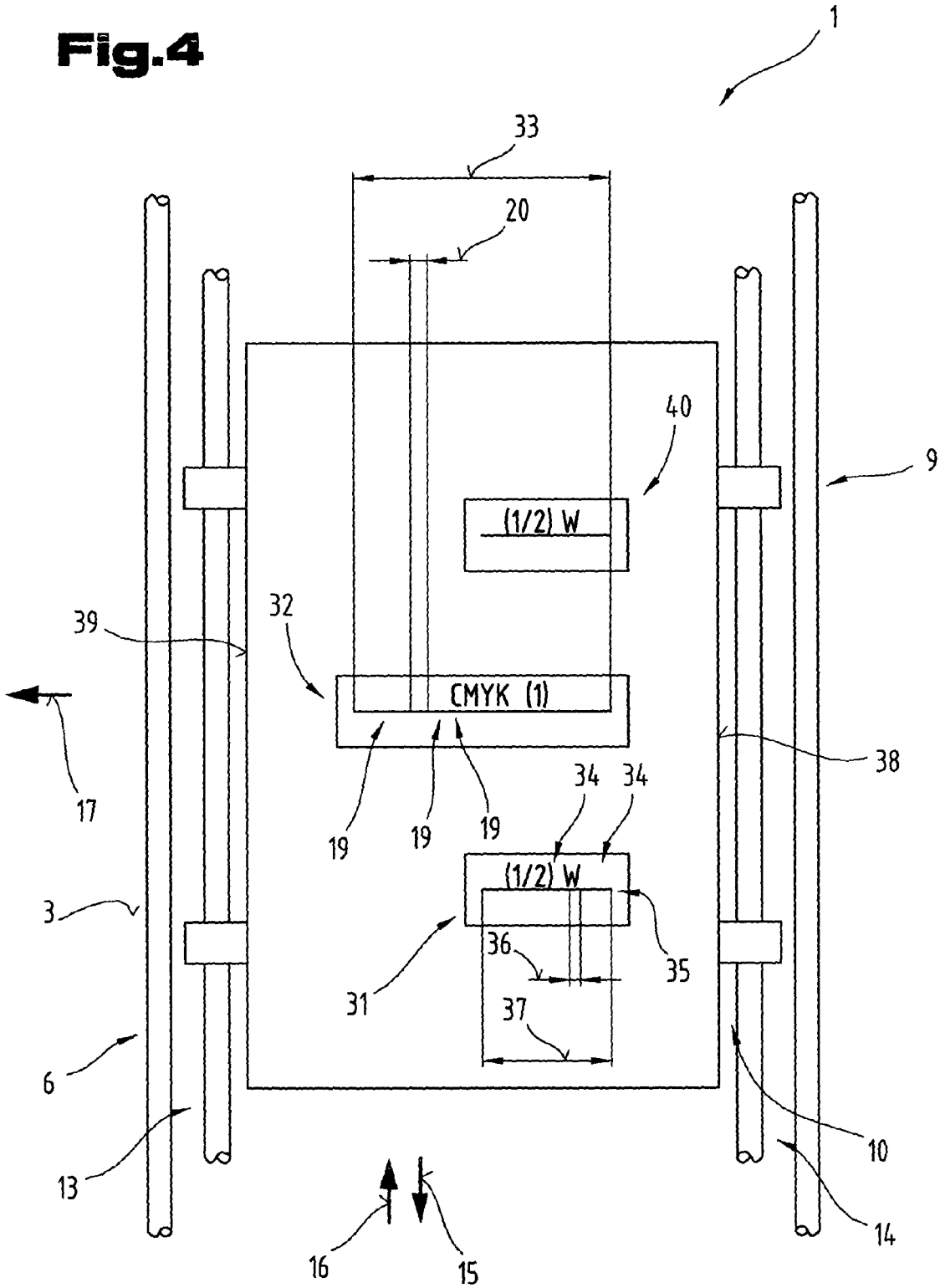
FIG. 4 illustrates an example of another embodiment of the inkjet printer 1 with a second print head unit for applying white ink.

FIG. 4 illustrates another example of an embodiment of the inkjet printer 1 with a second print head unit 40 for applying white ink.

Whereas the print head unit 31 used to apply white ink is disposed in front of the colour print head unit 32 by reference to the transverse feed direction 15, the second print head unit 40 for applying white ink lies opposite the first print head unit 31, i.e. the colour print head unit 32 is arranged in front by reference to the transverse feed direction 16 opposite the first transverse feed direction 15. This means that both when moving out in the transverse feed direction 15 and when moving back in the transverse feed direction 16, a base coat of white ink can be applied with the corresponding respective upstream print head unit 31 or 40, followed by an immediate application of coloured ink dots on top of the area of the print medium 3 to which a base coat has just been applied.

Figure 5:
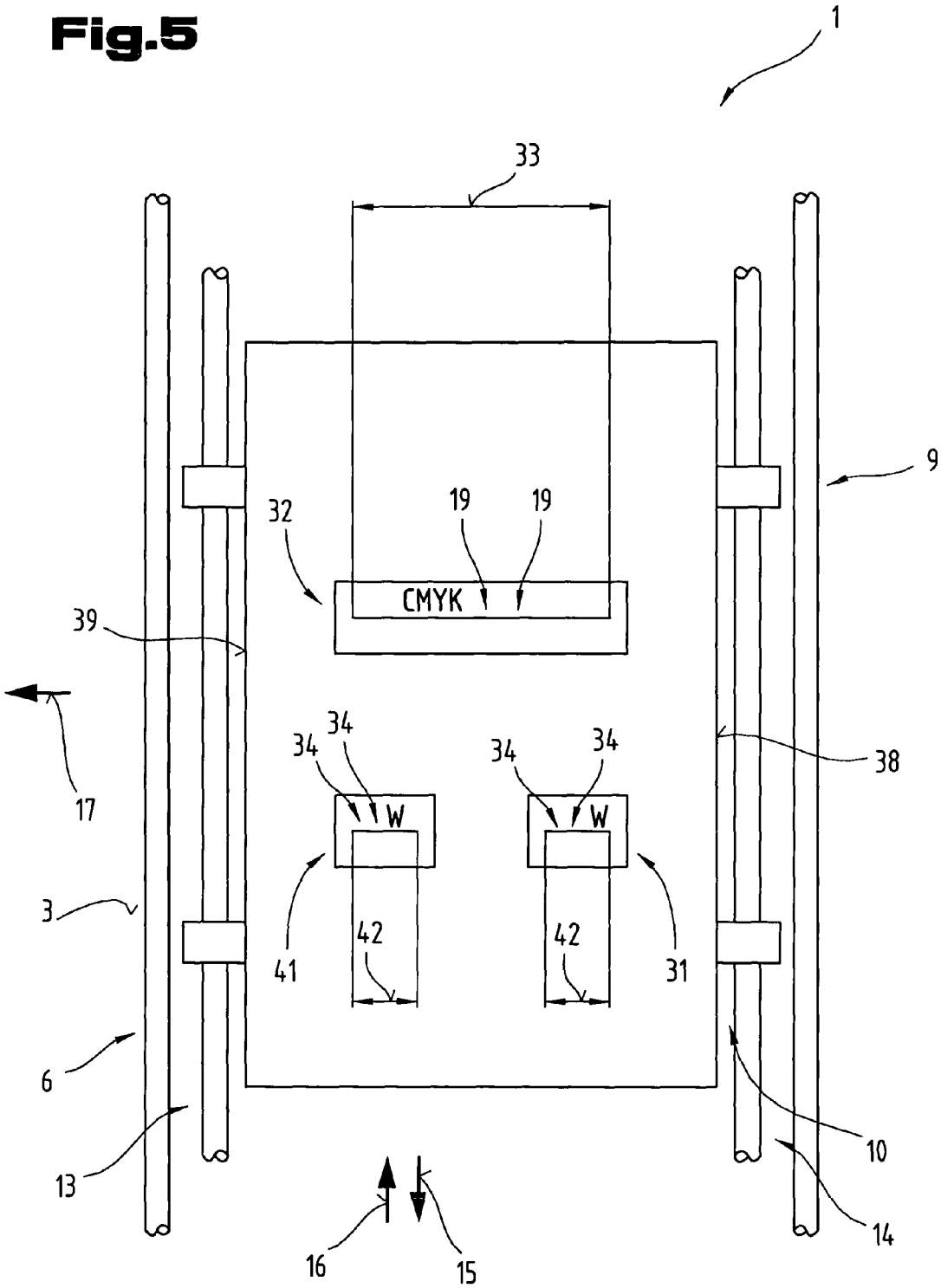
FIG. 5 illustrates an example of an embodiment of the inkjet printer with another print head unit for applying white ink, which is disposed in the region facing the rear face 39 of the print head carriage 10.

FIG. 5 illustrates an example of an embodiment of the inkjet printer 1 with another print head unit 41 for applying white ink, which is disposed in the region facing the rear face 39 of the print head carriage 10.

Another variant of the inkjet printing method described above can be implemented as a result of this disposition of the print head unit 41. The print head unit 41 in this instance is used as an alternative to the print head unit 40 and is preferably provided as a means of applying images to the rear face of transparent print media 3, as will be described below with reference to FIGS. 9 and 10. If images of this type are intended to be viewed from the front face of the print medium 3, it is necessary to apply the coloured ink dots to the print medium 3 first of all, by means of the nozzles 19 of the colour print head unit 32. In the embodiment illustrated as an example in FIG. 5, the two print head units 31 and 41 for applying white ink have a row length 42, the value of which is a quarter of the row of row length 33 of the colour print head units 32. This means, for example, that with a dot density of 90 dpi for the colour print head unit 32, the print head units 31, 41 have a dot density at the nozzles 34 of 360 dpi. The coloured ink dots are therefore preferably applied by the colour print head unit 32 using the nozzles 19 disposed outside of the area where the row length 42 of the print head unit 41 overlaps with the row length 33 of the colour print head unit 32. However, it is also possible to apply coloured ink dots to the print medium 3 first of all by means of the nozzles 19 from the area where row length 42 and row length 33 overlap during a transverse feed of the print head carriage 10 in the direction of the transverse feed direction 16, in which case the next print head unit 41 then applies the white ink dots immediately afterwards, overlapping the coloured ink dots previously applied. Naturally, this approach is only possible by moving the print head carriage in the transverse feed direction 16.

Likewise by providing a second print head unit 40 for applying white ink opposite the first print head unit 31, as illustrated in FIG. 4, it is also possible to provide another print head for applying white ink (not illustrated) lying opposite the print head unit 41. These features also enable the productivity or speed of the printing process using the inkjet printer 1 to be increased.

A more detailed description of how ink dots of white ink and coloured ink are applied to the print medium 3 will be given with reference to FIGS. 6 to 10.

Figure 6:
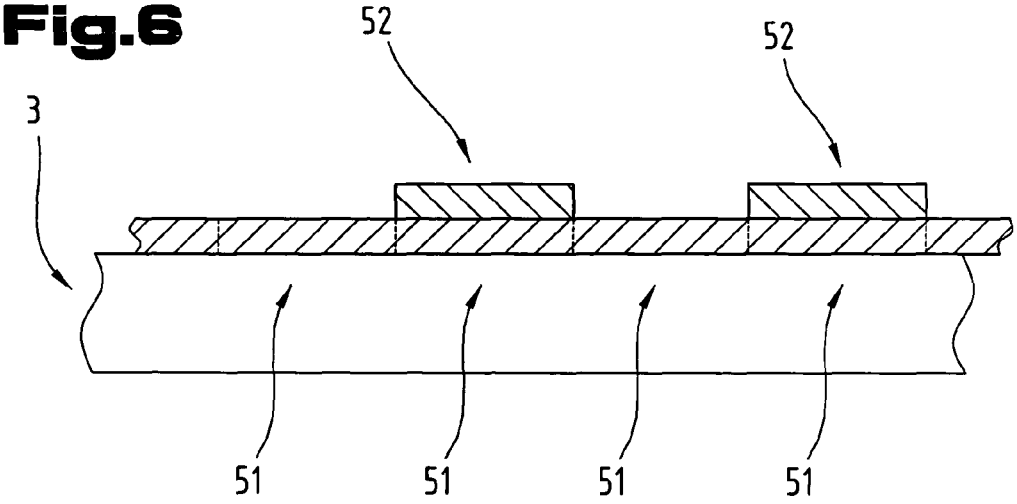
FIG. 6 is a very much enlarged diagram showing a cross-section of the print medium with white and coloured ink dots applied to it in the situation where a base coat is applied to an image.

FIG. 6 is a diagram on a very much enlarged scale showing a cross-section of the print medium 3 with white and coloured ink dots applied to it in the situation where an image is provided with a base coat.

The base coat of white ink is made up of densely adjacent white ink dots 51. Coloured ink dots 52 are then applied on top of this base coat. If the print medium 3 is a non-white material, a reproduction of a coloured image with true colours—or at least improved colours—can be obtained as a result of the base coat of white ink dots 51.

Figure 7:
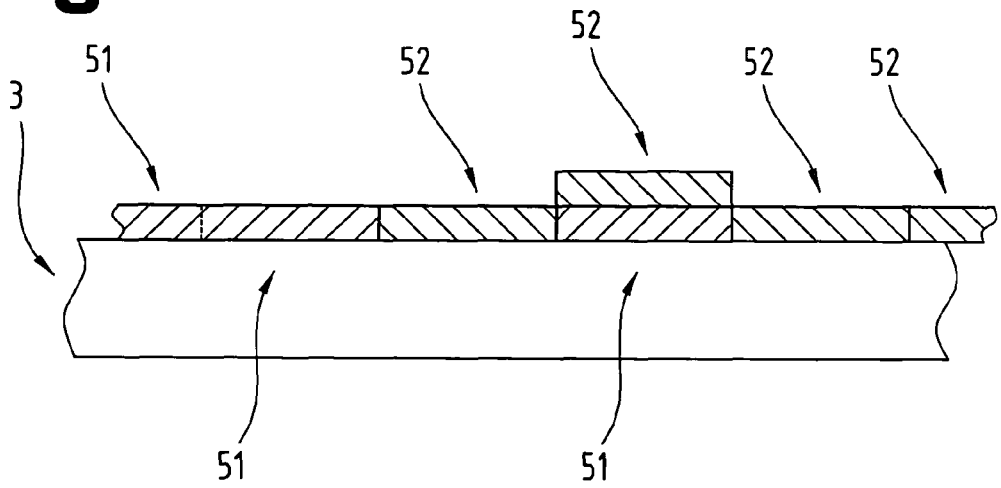
FIG. 7 shows a detail of an image applied to a print medium in which white ink dots are applied to only certain areas.

FIG. 7 illustrates a detail of an image applied to a print medium 3 with white ink dots 51 applied to certain regions only.

In this case, three coloured ink dots 52 have a base of a white ink dot 51, as a result of which the coloured ink dots 52 are lighter and the perceived colour intensity is reduced as a result.

Figure 8:
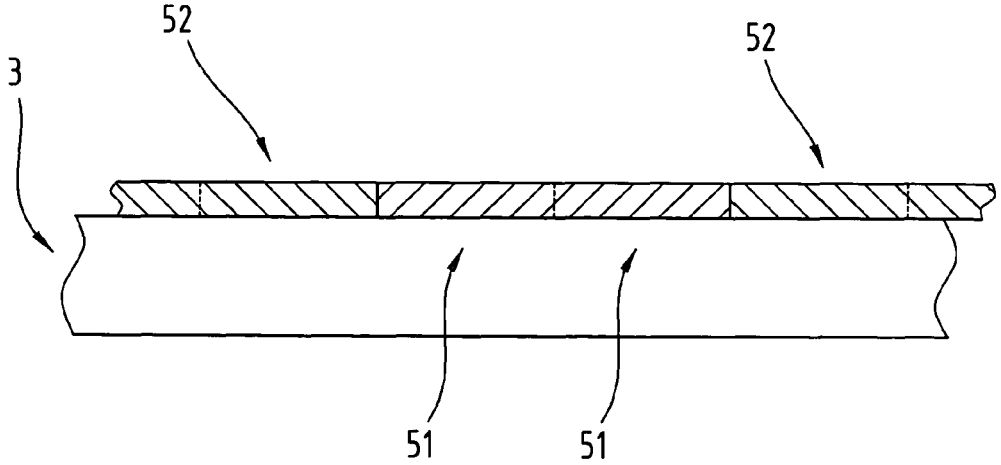
FIG. 8 is an example of an embodiment of an image applied to a print medium, in which the white ink dots form a filler region between coloured ink dots.

FIG. 8 illustrates an example of an embodiment of an image applied to a print medium, where white ink dots 51 form a filled region between coloured ink dots 52.

The inkjet printer 1 applies an image to the print medium 3 on the basis of digital image information or image data, which is contained in an appropriate data file in electronic format. The white ink dots 51 may be applied to the print medium 3 in two different ways. Either the relevant image information pertaining to the white ink dots 51 is already contained in the corresponding image data file and is stored as such or an image data file is provided which contains only image data pertaining to the coloured ink dots 52. In the latter case, before printing the image with the inkjet printer 1, empty areas between the coloured ink dots 52 can be completed by image data for white ink dots 51 under the control of software, thereby enabling the empty areas to be filled with white ink.

Figure 9:
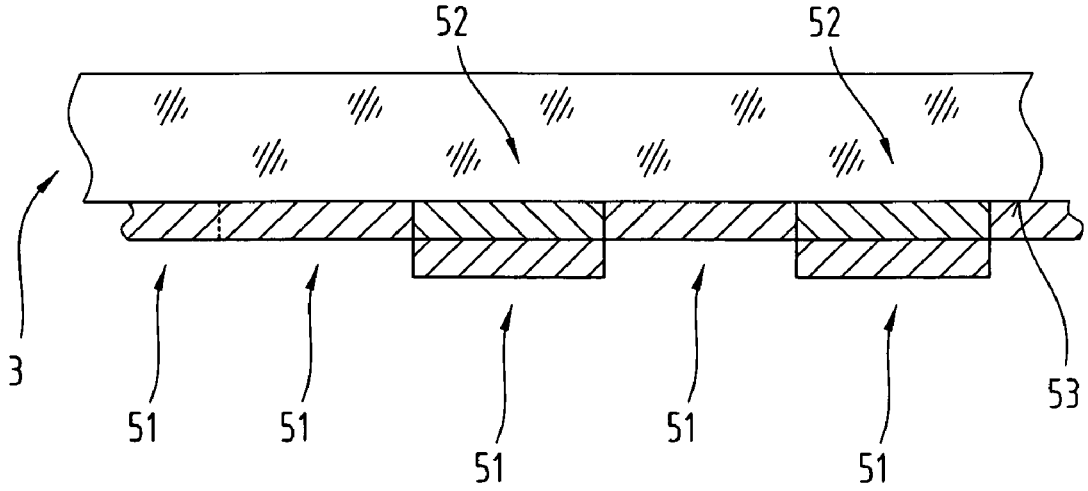
FIG. 9 shows a cross-section through a transparent print medium with an image applied to the reverse face of the print medium.

FIG. 9 illustrates a cross-section through a transparent print medium 3 with an image applied to a reverse face 53 of the print medium 3.

The situation corresponds to the reverse case of FIG. 6, where a base coat is applied to a non-transparent print medium 3. In this case, the coloured ink dots 52 are applied to the print medium 3 first of all, after which white ink dots 51 are applied to the entire area of the image at every point, both on top of the coloured ink dots 52 and in the areas lying in between.

Figure 10:
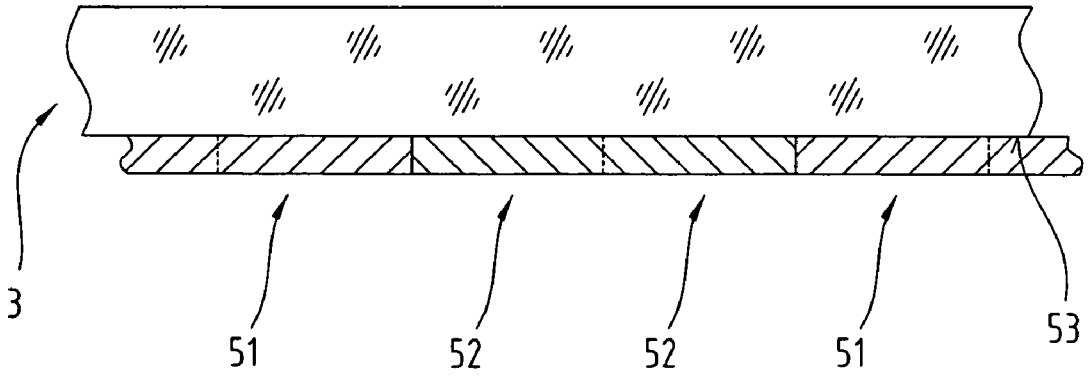
FIG. 10 shows another example of an embodiment of an image applied to a transparent print medium.

FIG. 10 illustrates another example of an image 53 applied to a transparent print medium 3.

In this case, areas lying between coloured ink dots 52 are filled with white ink dots 51. Accordingly, this situation corresponds to the case of the embodiment illustrated in FIG. 8 using a non-transparent print medium 3.

Figure 11:
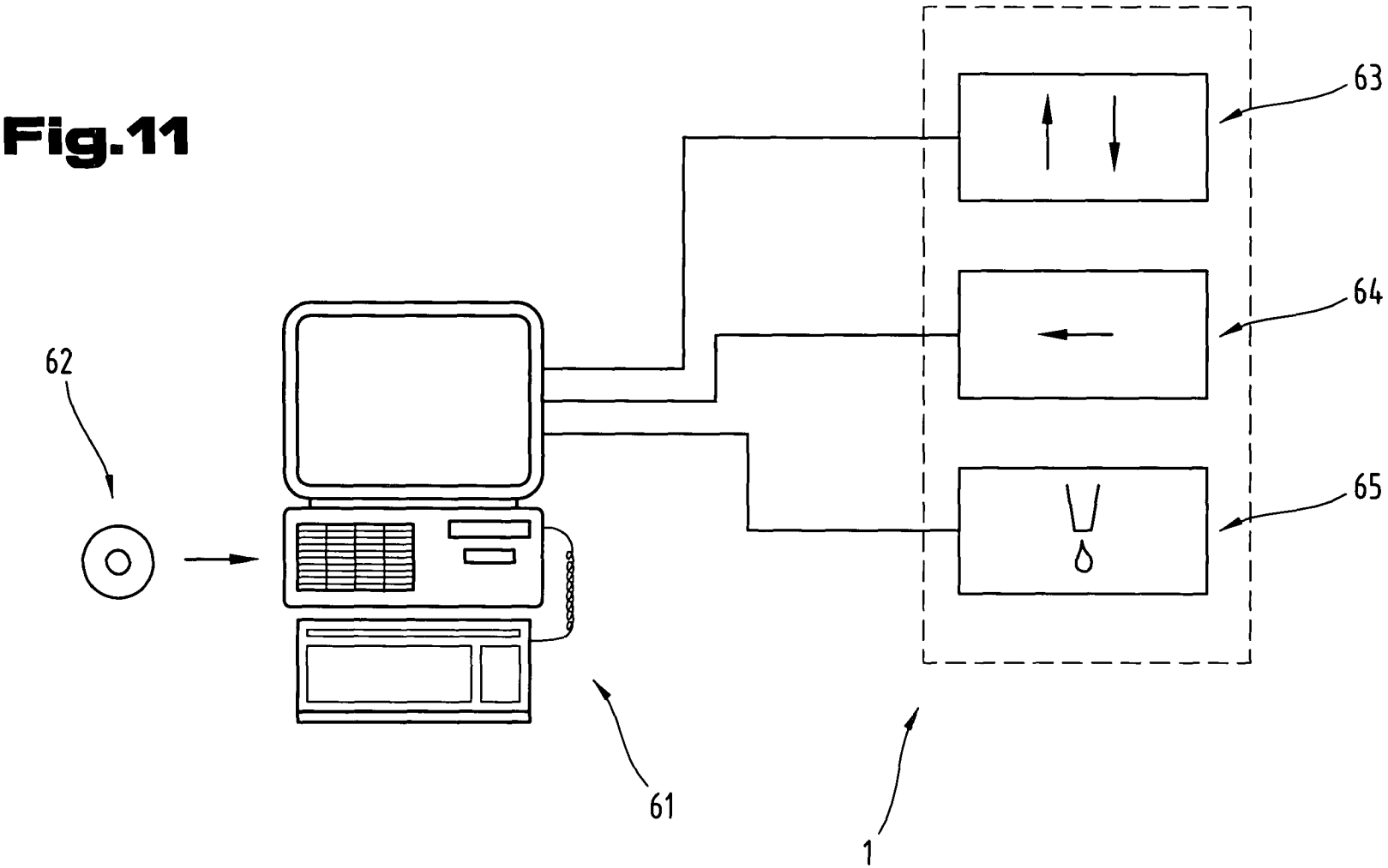
FIG. 11 is a schematic diagram illustrating the signalling process and control of the inkjet printer.

FIG. 11 is a schematic diagram illustrating the signalling process or operational control of the inkjet printer 1.

For control purposes, the inkjet printer 1 is connected to a control unit 61, usually in the form of a personal computer. On the basis of digital image data 62 entered in the control unit 61, a computation of the control signals of the corresponding individual components of the inkjet printer 1 is run in this control unit 61. To this end, the control unit 61 is connected to a carriage control 63 for displacing the print head carriage 10 in the transverse feed direction 15, 16, a forward feed control 64 for activating the forward feed mechanisms 6, 9 in order to displace the print medium 3 in the forward feed direction 17 and a nozzle control 65 for activating the nozzles 19, 34 so as to eject white and coloured inks onto the print medium 3 (FIG. 1 to 5).

The image data 62 is usually present in the form of digital image information and can be stored in different electronic file formats. Before the image data can be forwarded to the nozzle control 65, it may therefore be necessary to convert the digital image data into data for the individual colours, cyan, magenta, yellow and black.

In a first printing mode for operating the inkjet printer 1, the image data 62 already contains information for printing white ink and data indicating the points of the image where white ink dots 51 are to be applied (see FIGS. 6 to 10). The colour information can thus be processed directly, apart from the conversion of the image data which may be necessary and splitting of the signals for the individual coloured ink dots 52 (cyan, magenta, yellow and black and optionally any other colours) and white ink dots 51.

In a second printing mode, no information about applying white ink is contained in the image data 62. In other words, in the corresponding image data, only those points of the image at which a coloured ink dot 52 is to be applied are fixed in the image data. In this second printing mode, the transparent surfaces disposed between the coloured ink dots 52 are then filled with white ink. To this end, the image data for the white ink dots 51 is computed in the control unit 61 before the corresponding control signals can be forwarded to the nozzle control 50. In this manner, the visual impression of a white background medium is created. The process of filling transparent areas in this manner may optionally be switched on or off in this printing mode, by entering the appropriate settings in the control unit 61.

In a third printing mode of the inkjet printer 1, a base coat of white ink is applied to the entire image. In other words, before the coloured image is printed, the print medium 3 is provided with a base coat of white across the entire surface by applying white ink dots 51. The original colour of the print medium 3 is therefore covered and the coloured image is printed on a white surface. The advantage of this is that a coloured reproduction with true colours can be obtained if using print media 3 of a non-white material. This printing mode may be used for both image data 62 containing image information about white ink as well as for image data 62 which does not contain such information about white ink.

In a fourth printing mode, the sequence of applying white ink dots 51 and coloured ink dots 52 is reversed. This printing mode is intended for applying coloured images to the reverse face 53 of a transparent print medium 3 (FIGS. 9, 10) and may also be set up by entering the appropriate settings at the control unit 61.

Although in the description given above it is always the other print head units 31, 40, 41 which are used to apply white ink and create white ink dots 51, they can also be operated with any other colour. Accordingly, applications would also be conceivable in which an image can be produced with a base coat of ink in a colour other than white.

When using the inkjet printer 1 and the method of printing images, it is preferable to use differently coloured inks which dry at approximately the same rate.

Figure 12:
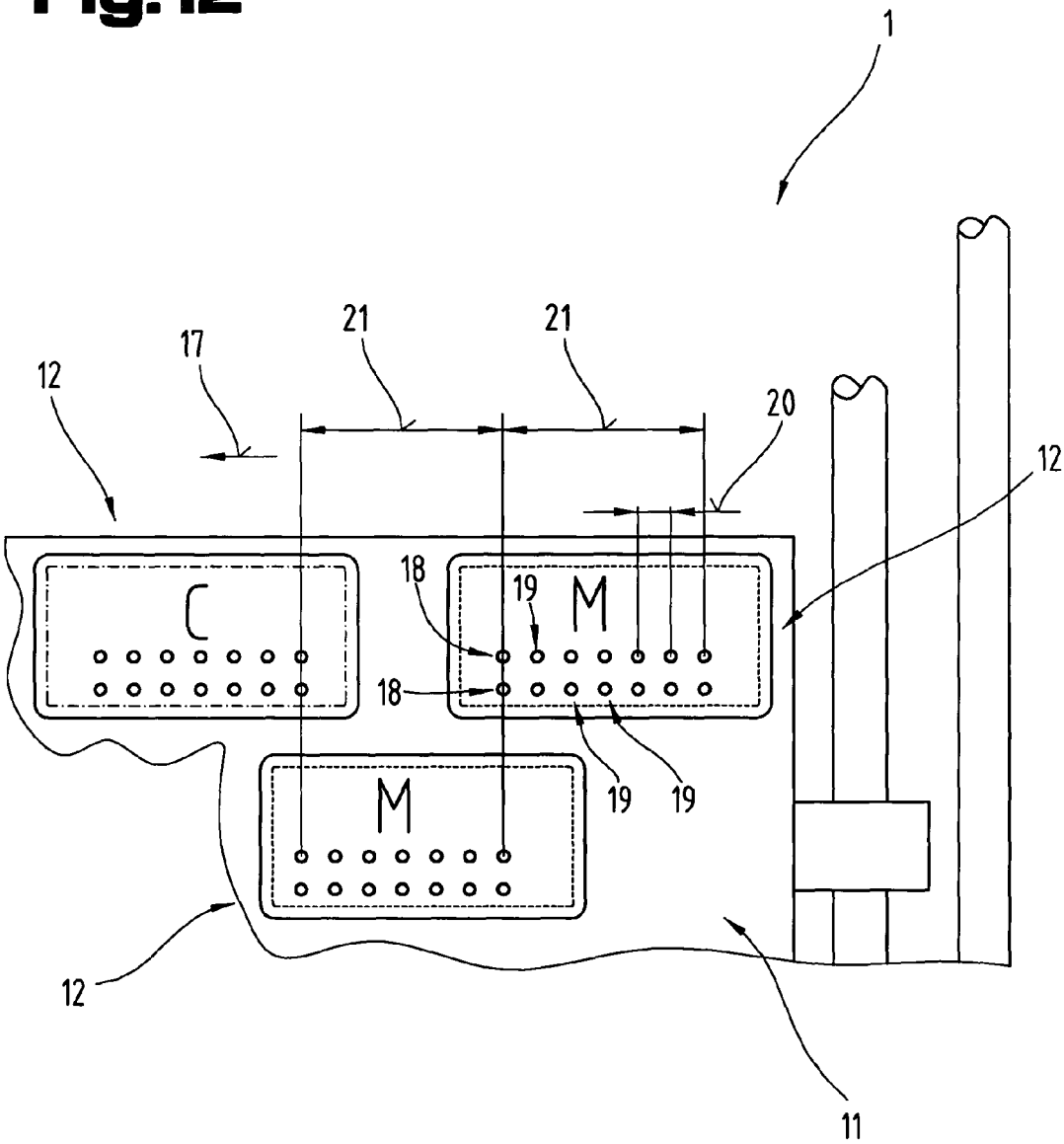
FIG. 12 is a cut-away view of the print head unit of the inkjet printer illustrated in FIG. 2 with a different variant of the print heads.

FIG. 12 shows a part of the print head unit of the inkjet printer 1 illustrated in FIG. 2 with a different variant of the print head 12.

In the embodiment illustrated as an example here, the print heads 12 each have two nozzle rows 18. Within each of the nozzle rows 18, which preferably extend parallel with the forward feed direction 17 of the print medium 3, the individual nozzles 19 are respectively spaced apart from one another by the nozzle distance D 20. Respective nozzles 19 lying adjacent to one another by reference to the transverse feed direction 15 therefore form nozzle rows corresponding to the ink dots 51 applied to the print medium 3 (FIGS. 6 to 10). Naturally, it would also be possible to use print heads 12 with more than two nozzle rows 18. The advantage of this is that a higher output capacity of the inkjet printer 1 can be achieved. At the same time, it would also be possible to apply two or more ink dots 51, 52 to the print medium 3, one on top of the other, during a single displacement of the print head unit 11 in the transverse feed direction 15, 16 at one and the same point of the image.

Figure 13:
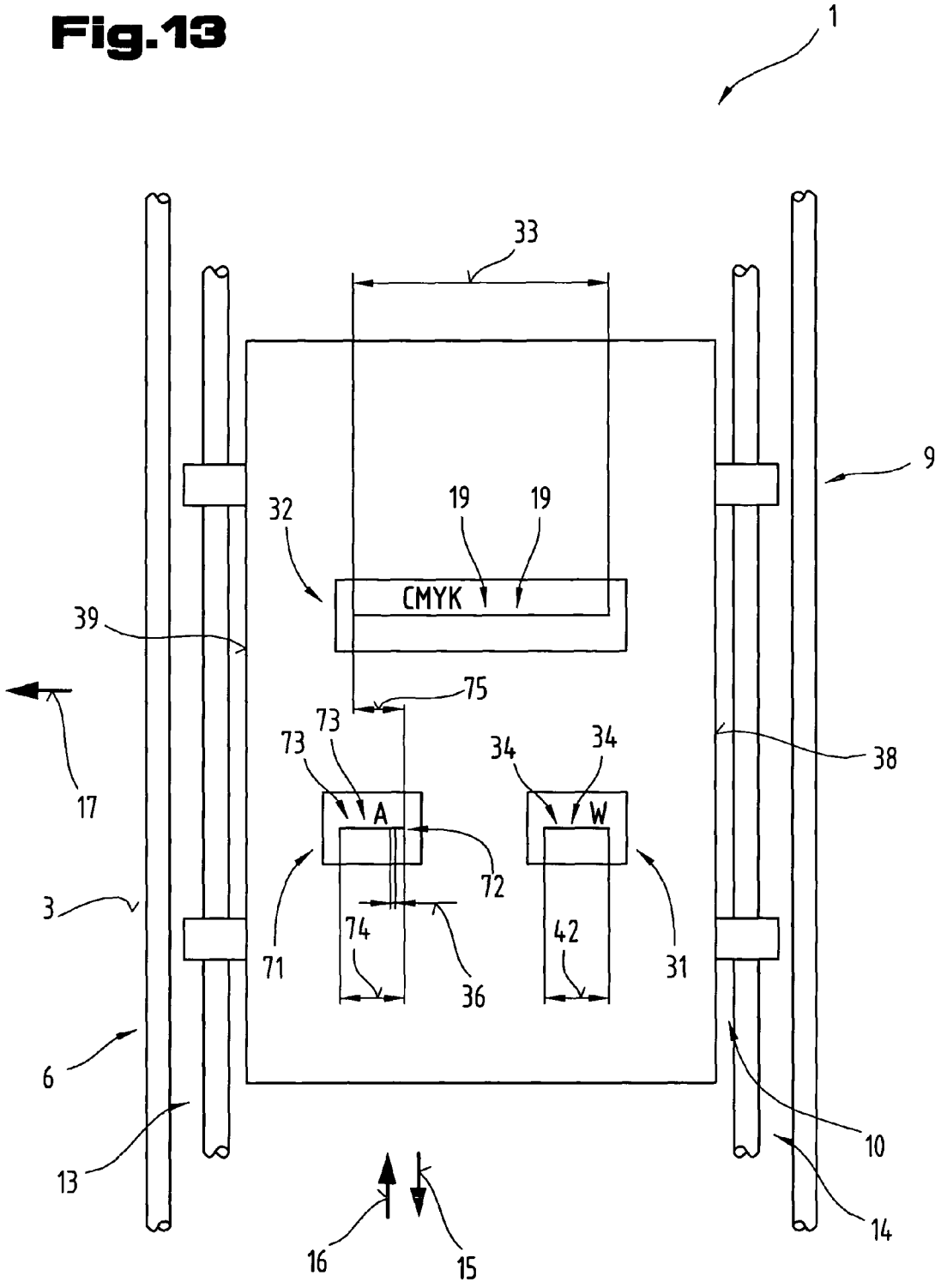
FIG. 13 is an example of an embodiment of the inkjet printer with a print head unit for applying colourless or achromatic ink.

FIG. 13 illustrates an embodiment of the inkjet printer 1 with a print head unit 71 for applying colourless or achromatic ink.

The print head or print head unit 71 for applying colourless ink has a nozzle row 72 with nozzles 73 spaced apart from one another by the nozzle distance d 36 by reference to the forward feed direction 17 of the print medium 3. The print head unit 71 is disposed in the region facing the rear face 39 of the print head carriage 10 and the row length 33 of the colour print head unit 32 and a row length 74 of the print head 71 at least partially overlap with one another. Using the print heads or print head unit 71 for applying achromatic ink, an image can be covered with colourless, i.e. transparent ink, by the colour print head unit 32, thereby producing different visual effects. For example, a uniform gloss can be produced by additionally applying colourless ink to the entire image. This reduces the appearance of stripes due to tilting effects. Alternatively, individual areas of text or graphic elements may be coated with colourless ink, enabling them to be more clearly highlighted in the image.

In the same way as the nozzles 34 of the print head unit 31 for applying white ink, the nozzles 73 of the print head unit 71 for applying colorless ink have a higher dot density—with a nozzle distance d 36. An image is applied to the print medium 3 by firstly applying colored ink dots 52 with the nozzles 19 of the color print head unit 32 (FIGS. 6 to 8) and then, after a forward displacement of the print medium 3 in the forward feed direction 17, applying the colorless or transparent ink on top of the colored ink dots 52.

The print heads or the print head unit 71 for the colorless ink are disposed at the paper outlet, i.e. in the area facing the rear face 39 of the print head carriage 10 and have a dot density of 180 dpi, for example. As a result of the lower resolution of the print heads of the color print head unit (for example 90 dpi) compared with the desired image resolution of 360 dpi, for example, the complete colored image is obtained by a combination of printing routines operated by displacing the print head carriage in the transverse feed direction 15, 16 and paper displacements or displacements of the print medium 3 in the forward feed direction 17. When running the "over-print" function, it may be that some of the nozzles 19 of the color print head unit 32 are not used because the colorless ink has to be applied last of all. By using the print heads or the print head unit 71 with the higher dot density (180 dpi), this proportion, disposed in an overlap region 75, is reduced and productivity increased. Accordingly, the number of nozzles 73 of the print head unit 71 is preferably the same as the number of nozzles 19 of the color print head unit 32, which means that the row length 74 is shorter, depending on the ratio of the dot density of the print head unit 71 to the dot density of the color print head unit 32. The colored ink dots 51 are applied by the print heads of the print head unit 32 by the nested printing method, i.e. alternate printing of lines and intermediate lines, using the interlacing method.

Like the print head unit 31 for the white ink, use of the print head unit 71 for applying colourless ink is preferably provided as an optional feature only and if it is used, when the colour print head unit 32 is activated by the unit 61 (FIG. 11) controlling the nozzles 19, only those nozzles 19 which lie outside the overlap region 75 between the row length 33 of the colour print head unit 32 and the row length 74 of the print head unit 71 are activated. The initially applied coloured ink dots 52 are not covered with colourless ink dots 52 by the print head unit 71 until after an appropriate forward displacement of the print medium 3 in the forward feed direction 17. Another possible way of operating the inkjet printer 1 is to apply colourless ink to points of an image for which there are no coloured image dots in the image data 62. In this mode of operating the inkjet printer 1, it is naturally also possible to use those nozzles 19 of the print heads of the colour print head unit 32 which lie in the overlap region. In other words, during the same transverse displacement of the print head carriage 10 in the transverse direction 15, 16, both nozzles 73 of the print head unit 71 and also nozzles 19 of the colour print head unit 30 lying in the overlap region 75 can be activated.

Turning to FIGS. 14 to 19, a description will now be given of various modes of operating the inkjet printer with the additional print head unit 71 for applying colourless ink, as well as the creation of a printed image on a print medium 3 and an image applied to it.

Figure 14:
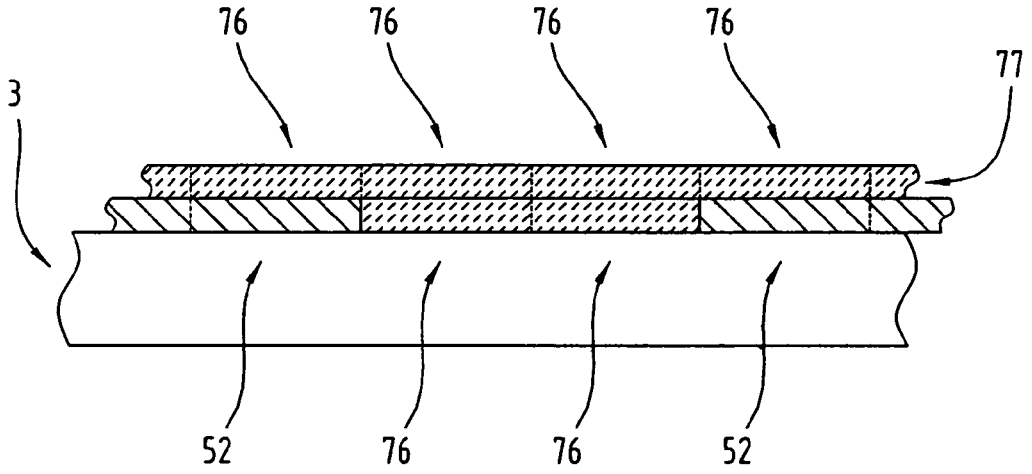
FIG. 14 shows a cross-section of a print medium with an image applied to it, on a very much enlarged scale.

FIG. 14 shows a cross-section of a print medium 3 with an image applied to it, shown on a very much enlarged scale. The image, defined by the image data 62 (FIG. 11), is created by firstly applying the colored ink dots 52 to the print medium. On top of the colored ink dots 52, colorless ink dots 76 are then applied, which form a coat 77. The colorless ink dots 76 are formed by applying a colorless lacquer, for example. A uniform gloss is created as a result of this coat 77 applied on top of the image made up of the colored ink dots 52. In particular, the coat 77 eliminates tilting effects. Due to the printing process, which involves a series of displacements of the print head carriage 10 in the transverse feed direction 15, 16 whilst simultaneously applying ink, a strip-shaped structure can occur which is perceptible when the image is viewed from an oblique angle. This effect is largely compensated by the coat 77 of colorless ink or colorless lacquer so that it disappears.

Figure 15:
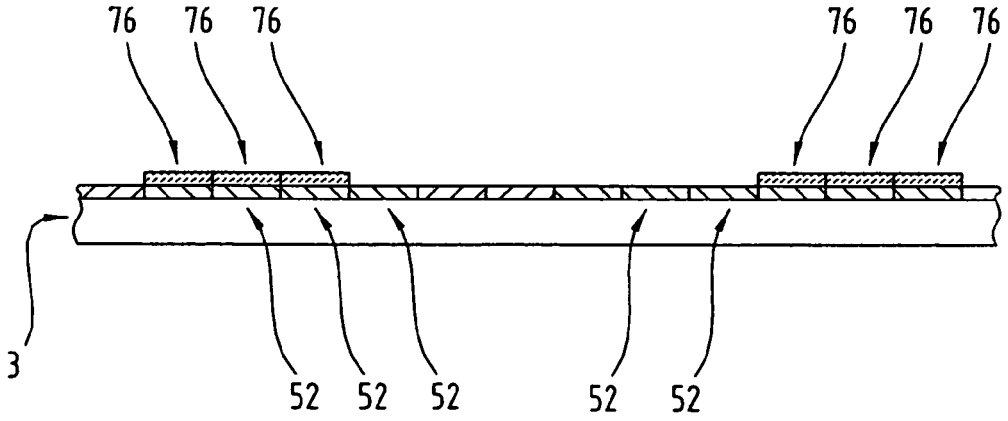
FIG. 15 illustrates another example of an embodiment of a colourless ink applied to the print medium but only in certain regions.

FIG. 15 illustrates another example of an image applied to the print medium 3 with colourless ink applied in addition but only to certain regions. Colourless ink in the form of ink dots 76 is applied to selected areas on top of the image comprising the coloured ink dots 52. This enables graphics or text elements in the corresponding areas to be highlighted due to the higher gloss of the colourless ink dots 76. Although the colour in the relevant areas remains unaltered, an additional visual effect is achieved, imparting structure to the image, due to applying colourless ink to certain areas.

Figure 16:
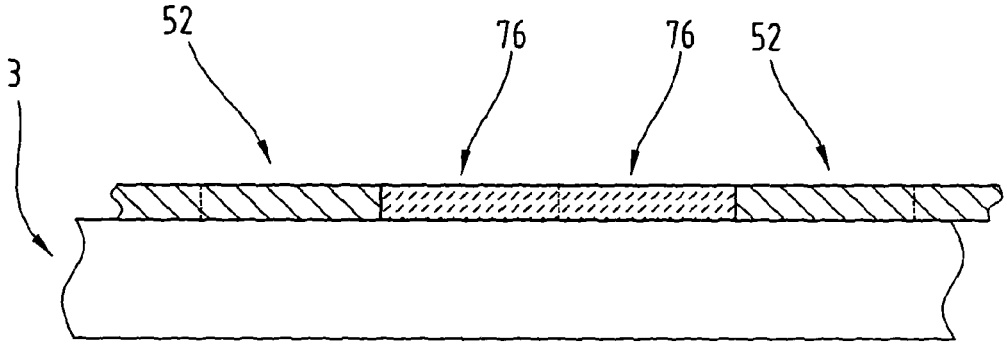
FIG. 16 illustrates another embodiment for applying an image to the print medium with complementary ink dots of colourless ink.

FIG. 16 illustrates another variant in the situation where an image is applied to the print medium 3 with complementary ink dots 76 of colourless ink. In the case of digital images for which the image data 62 (FIG. 11) contains areas in which no coloured ink dots 52 are to be applied, colourless ink or colourless lacquer is applied to the relevant empty areas if adopting this approach, so that intermediate spaces are filled with colourless ink dots 76. This complementary application of colourless ink dots 76 represents an optional operating mode of the inkjet printer 1 and requires a computation of control signals for the additional ink dots 76 not contained in the image data 62 in the control unit 61 (FIG. 11). The print head unit 71 (FIG. 13) for applying the colourless inks is controlled on the basis of these additionally computed control signals. This complementary application of colourless ink dots 76 can also compensate for the surface properties of the print medium 3 and thus produce an image with a uniform gloss.

Figure 17:
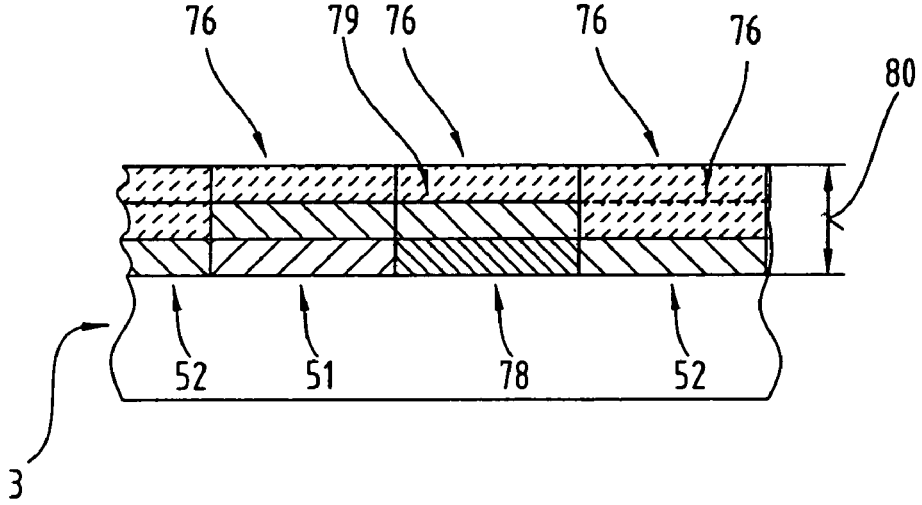
FIG. 17 is an example of an embodiment of an image applied to the print medium with several ink dots applied one on top of the other.

FIG. 17 illustrates an example of an image applied to the print medium 3 with several ink dots 51, 52, 76 applied one on top of the other.

At areas of individual image dots on the print medium, a first colour is applied by means of a first ink dot 78 and a second colour is applied by means of a second ink dot 79, thereby enabling an appropriate mixed colour to be created. Naturally, image dots consisting of only a single coloured ink dot 52 may also be applied. On top of the ink dot 79 and on top of the ink dots 52, ink dots 76 are finally applied in the form of colourless ink. This being the case, the ink dots 51, 52, 53, 76, 78 and 79 in different areas of the image have an identical total thickness 80.

Figure 18:
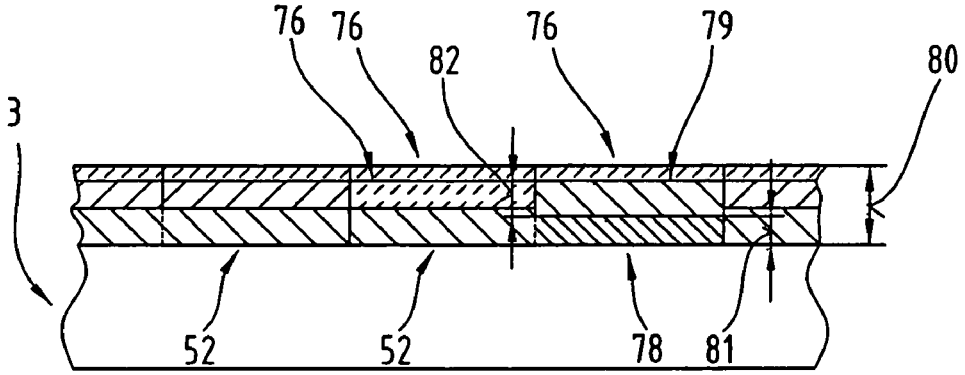
FIG. 18 is an example of an embodiment of an image applied to a print medium with several ink dots of differing coating thickness.

FIG. 18 illustrates an example of an image applied to a print medium 3 with several ink dots of differing coating thickness.

At the point of an image dot, the first ink dot 78 has a first thickness 81 and the second ink dot 79 lying on top has a second thickness 82. The different thicknesses 81, 82 of the ink dots 78, 79 are obtained by applying different volumes of ink. This also enables the mixed colours created to be additionally varied. Furthermore, the ink dots 51, 52, 76, 78 and 79 in different areas of the image are finished so that they have the same total thickness 80 as one another.

Figure 19:
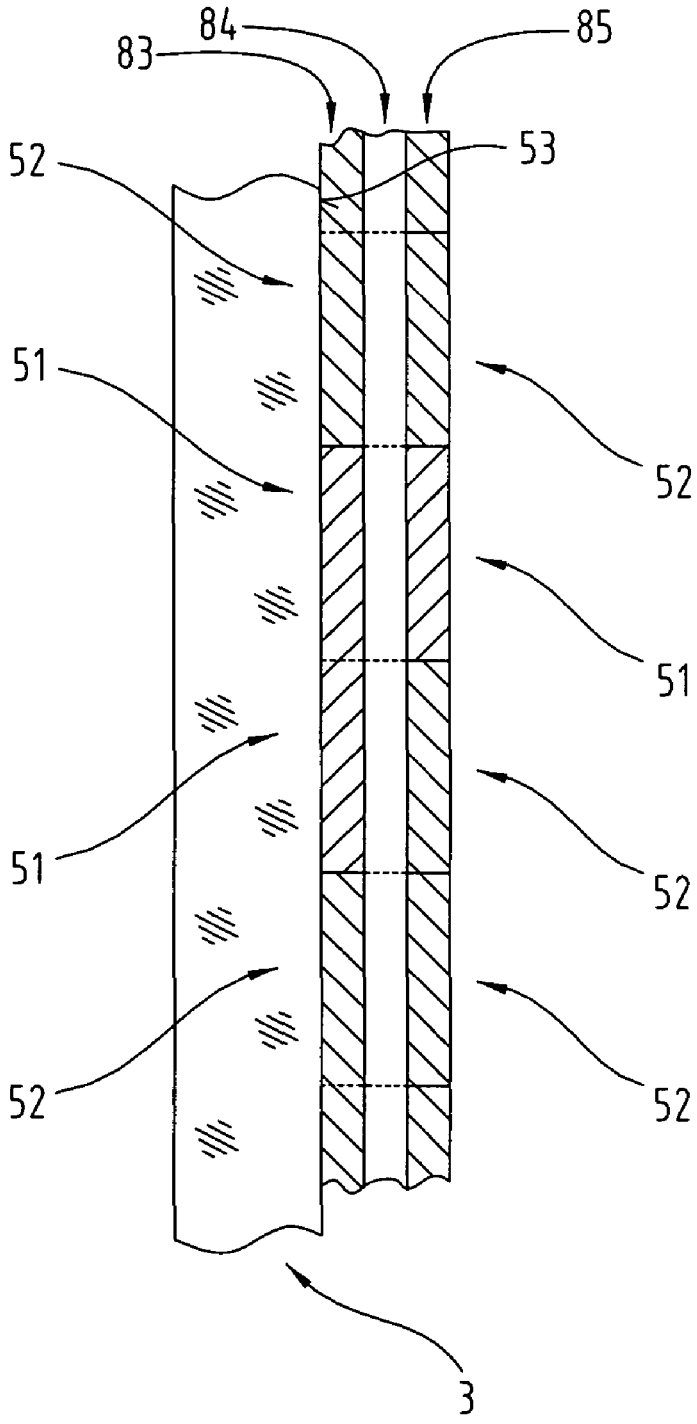
FIG. 19 is another example of an embodiment for applying images to a transparent print medium.

FIG. 19 illustrates another example used to apply images to a transparent print medium 3.

A first image 83 intended to be seen through the print medium 3 is firstly applied to one face or the reverse face 53 of the transparent print medium 3, which may consist of coloured ink dots 52 as well as white or colourless ink dots 51, 76. On top of this first image 83, a coat 84 is then applied which consists of only white ink dots 51. Finally, a second image 85, which may also consist of coloured ink dots 52 as well as white or colourless ink dots 51, 76, is then applied on top of this white coat 84. By adopting this approach, a printed image can be created with two images 83, 85 visible from different directions or from different sides of the print medium 3, in a single print routine. The advantage of this is that image elements of the respective remote image, which are applied to the oppositely lying side with appropriate other image elements as a covering layer, can be positioned very precisely. This advantageously produces effects of the type used as safety features on bank notes, such as water marks for example. The degree to which the image or image elements of the respective remote face show through on the viewed side of the print medium 3 or are visible there can be varied or fixed by selecting the thickness of the white coat 84.

The embodiments illustrated as examples show different possible embodiments of the inkjet printer (1) and it should be pointed out that this stage that the invention is not restricted to the specific variants described here. Different combinations of the individual embodiments may also be used in conjunction with one another, these various options being within the capability of the person skilled in this technical field based on the technical teaching pertaining to the invention. Accordingly, all conceivable embodiments obtained by combining individual details of the variants illustrated and described are possible and fall within the scope of the invention.

For the sake of good order, it should finally be pointed out that in order to provide a clearer understanding of the structure of the inkjet printer 1, it and its constituent parts are illustrated to a certain extent out of scale and/or on an enlarged scale and/or on a reduced scale.

The independent solutions proposed by the invention to achieve the underlying objective may be found in the description.

Above all, the individual embodiments illustrated in FIGS. 1, 2; 3; 4; 5; 6; 7; 8; 9; 10; 11; 12; 13; 14; 15; 16; 17; 18 and 19 may be construed as independent solutions to the objective set by the invention. The objectives and associated solutions proposed by the invention may be found in the detailed descriptions of the these drawings.

List of Reference Numbers

| | |
|---|---|
| 1 | Inkjet printer |
| 2 | Printing bed |
| 3 | Print medium |
| 4 | Transport roller |
| 5 | Transport roller |
| 6 | Feed mechanism |
| 7 | Transport roller |
| 8 | Transport roller |
| 9 | Feed mechanism |
| 10 | Print head carriage |
| 11 | Print head unit |
| 12 | Print head |
| 13 | Transverse guide |
| 14 | Transverse guide |
| 15 | Transverse feed direction |
| 16 | Transverse feed direction |
| 17 | Feed direction |
| 18 | Nozzle row |
| 19 | Nozzle |
| 20 | Nozzle row distance D |
| 21 | Row length |
| 22 | Pitch ΔB |
| 31 | Print head unit |
| 32 | Colour print head unit |
| 33 | Row length |
| 34 | Nozzle |
| 35 | Nozzle row |
| 36 | Nozzle row distance |
| 37 | Row length |
| 38 | Front face |
| 39 | Rear face |
| 40 | Print head unit |
| 41 | Print head unit |
| 42 | Row length |
| 51 | Ink dot |
| 52 | Ink dot |
| 53 | Reverse face |
| 61 | Control unit |
| 62 | Image data |
| 63 | Carriage control |
| 64 | Feed control |
| 65 | Nozzle control |
| 71 | Print head unit |
| 72 | Nozzle row |
| 73 | Nozzle |
| 74 | Row length |
| 75 | Overlap region |
| 76 | Ink dot |
| 77 | Coating |

-continued

| List of Reference Numbers | |
|---|---|
| 78 | Ink dot |
| 79 | Ink dot |
| 80 | Total thickness |
| 81 | Thickness |
| 82 | Thickness |
| 83 | Image |
| 84 | Coating |
| 85 | Image |

What is claimed is:

1. Inkjet printer with a printing bed for displacing a print medium in a forward feed direction and with a print head carriage disposed above the printing bed for displacing at least one color print head unit in a transverse feed direction, one print head unit with at least one print head being provided for the at least one color print head unit, and every print head has at least one nozzle row oriented in the forward feed direction of the print medium and the at least one color print head unit has an effective row length, wherein another print head unit with nozzles disposed in at least one nozzle row and of an effective row length is provided, the another print head unit is provided as a means of applying white ink, and the effective row length of the at least one color print head unit and the effective row length of the another print head unit at least partially overlap each other in the transverse feed direction, and a control unit for a nozzle control is provided for activating the nozzles, and, of the nozzles of the nozzle row of the at least one color print head unit, only those nozzles lying outside of an overlap region between the effective row length of the at least one color print head unit and a row length of the another print head unit activated for applying white ink are activated.

2. Inkjet printer as claimed in claim 1, wherein the at least one color print head unit and the another print head unit are attached to a common print head carriage.

3. Inkjet printer as claimed in claim 1, wherein a second another print head unit is disposed lying opposite the another print head unit and the print head unit is disposed in front of the at least one color print head unit by reference to a first transverse feed direction, corresponding to an outward displacement, and the second another print head unit is disposed in front of the at least one color print head unit by reference to a second transverse feed direction corresponding to a return displacement.

4. Inkjet printer as claimed in claim 1, wherein the another print head unit is disposed in a region of the print head carriage facing the front face of the print head carriage and the front face is directed towards a region of the print medium moving towards the print head carriage.

5. Inkjet printer as claimed in claim 1, wherein nozzles of the at least one nozzle row of the at least one color print head unit are offset from one another by reference to the forward feed direction by a nozzle distance D and the nozzles of the at least one nozzle row of the another print head unit are offset from one another by a second nozzle distance d by reference to the forward feed direction of the print medium and wherein the ratio derived from the nozzle distance D and the second nozzle distance d is equal to 2.

6. Inkjet printer as claimed in claim 1, wherein the number of nozzles of the another print head unit is the same as the number n of the nozzles of the at least one color print head unit.

7. Inkjet printer as claimed in claim 1, wherein the at least one color print head unite has at least two print heads for each color to be printed, whereby a first print head of a color is disposed at a relative pitch $\Delta B$ from a second print head of the same color in the forward feed direction of the print medium and the pitch $\Delta B$ is equal to the sum of a whole-number multiple of the nozzle distances D and a fraction of the nozzle distances D.

* * * * *

UNITED STATES PATENT AND TRADEMARK OFFICE

CERTIFICATE OF CORRECTION

PATENT NO. : 7,794,077 B2
APPLICATION NO. : 11/056799
DATED : September 14, 2010
INVENTOR(S) : Klaus Falser, Peter Duracher and Franz Obertegger It is certified that error appears in the above-identified patent and that said Letters Patent is hereby corrected as shown below:

Column 16, line 3, "the print" should read --the another print--.
Column 16, line 30, "unite" should read --unit--.

Signed and Sealed this
Fourth Day of October, 2011

David J. Kappos

David J. Kappos
*Director of the United States Patent and Trademark Office*